US005092167A

United States Patent [19]

Finley et al.

[11] Patent Number: 5,092,167

[45] Date of Patent: Mar. 3, 1992

[54] METHOD FOR DETERMINING LIQUID RECOVERY DURING A CLOSED-CHAMBER DRILL STEM TEST

[75] Inventors: Douglas B. Finley, Carrollton; Alvey O. Bass, Midland, both of Tex.

[73] Assignee: Halliburton Company, Duncan, Okla.

[21] Appl. No.: 639,188

[22] Filed: Jan. 9, 1991

[51] Int. Cl.[5] ..... E21B 47/04

[52] U.S. Cl. ..... 73/155; 367/908

[58] Field of Search ..... 73/155, 290 V; 367/27, 367/33, 81, 908; 340/621

[56] References Cited

U.S. PATENT DOCUMENTS 4,123,937 11/1978 Alexander ..... 73/155
4,391,135 7/1983 Godbey et al. ..... 73/290 V X
4,934,186 6/1990 McCoy ..... 73/155 X

*Primary Examiner*—Jerry W. Myracle
*Attorney, Agent, or Firm*—C. Dean Dominque; Albert B. Deaver, Jr.

[57] ABSTRACT

Method for determining the volume of fluid produced and other production characteristics from a subterranean formation during a drill stem test based on determining the location of well fluid within the drill stem tubing by measuring the travel time of an acoustic signal reflected from the well fluid.

7 Claims, 1 Drawing Sheet

METHOD FOR DETERMINING LIQUID RECOVERY DURING A CLOSED-CHAMBER DRILL STEM TEST

BACKGROUND OF THE INVENTION

1. Field of the Invention

The present invention relates generally to improved methods for determining production characteristics of a subterranean formation, and more specifically relates to improved methods for determining the production rate of liquid recovery from a subterranean formation during a closed-chamber drill stem test.

2. Description of the Related Art

A drill stem test is a temporary completion of a particular strata or formation interval within a well. It is common in the industry to perform drill stem tests in order to determine useful information about the production characteristics of a particular formation interval.

In a conventional drill stem test, various tools are run into the well on a drill string. The number and types of tools available for use during a drill stem test are many and varied. However, in reality, only five tools are necessary to accomplish a drill stem test: drill pipe, a packer, a test valve, a perforated pipe, and instrumentation for measuring various properties of the well.

The drill pipe carries the tools to the bottom of the well and acts as a conduit into which well fluid may flow during the test. The packer seals off the reservoir or formation interval from the rest of the well and supports the drilling mud (if present) within the annulus during the test. The test valve assembly controls the test. It allows the reservoir or formation interval to flow or to be shut-in as desired. The perforated pipe, generally located below the packer, allows well fluid to enter the drill pipe in an open hole drill stem test. If the drill stem test is of a cased hole, the casing itself will have perforations. The instrumentation, typically pressure and temperature gauges, transduce properties of the well as a function of time.

Conventional drill stem tests consist of recording data from the well as the test valve is opened and well fluid is allowed to flow toward the surface. The time during which the test valve is open and the well is allowed to flow is called a "flow period." The resulting pressure and temperature data are then used to predict production capabilities of the tested formation interval in a manner well known in the art. In a conventional open flow drill stem test, the well fluid is allowed to flow to the surface (if possible) and typically on toward a pit. In a conventional closed chamber drill stem test, the well fluid is not allowed to flow to the surface but is allowed to flow into a closed chamber typically formed by the drill pipe.

Conventional drill stem tests are capable of determining the productivity, permeability-thickness, pressure, and wellbore damage of the tested formation interval as is well known in the art. The productivity, or the well's ability to produce fluid, is determined from the flow and shut-in periods. The productivity of the interval, used in combination with the rate of pressure recharge during periods when the interval is shut-in (i.e, the test valve is closed) yields an idea of the interval permeability-thickness. If interval pressure builds to near stabilization during the shut-in periods, interval pressure may be estimated. Finally, a comparison of flow and shut-in data yields an estimate of wellbore damage.

The quality of the formation characteristics determined from a conventional drill stem test are highly dependent upon the quality of the measurement of dynamic pressure. The ability of a pressure transducer to accurately measure small dynamic pressure changes greatly affects the results of conventional drill stem test data.

For high permeability-thickness wells, sensitive pressure transducers are required. High permeability-thickness wells are prone to rapid pressure changes. Thus, to measure the pressure changes as a function of time, the pressure measurements have to be made quickly and accurately. Pressure transducers that have high sensitivity can also measure and record pressures at higher frequencies. Moreover, in highly permeable wells the draw-down pressure may only be a few psi. To accurately measure this dynamic pressure trend, the gage sensitivity has to be significantly less than the draw-down pressure.

In a conventional closed chamber drill stem test, the influx of well fluids into the closed chamber causes the chamber pressure at the surface to increase. This increase in pressure over time is used to approximate the volume of well fluids produced by standard pressure-volume-temperature relationships well known in the art. L. G. Alexander of Canada was perhaps the first to introduce this method of approximating the volume of well fluids produced during a closed chamber drill stem test.

One of the problems inherent in this technique is that the well fluids produced are typically multi-phase in character (e.g., gas and liquid). During the test, the surface pressure is used to determine the volume of liquid produced or the volume of gas produced depending upon which phase predominates. Unfortunately, even the presence of small amounts of gaseous well fluid can create a large difference in the calculated amount of well fluids produced based on an all-liquid well fluid analysis.

Once the closed chamber test is completed, the amount of liquid well fluid produced can be measured. Down hole pressure gauge measurements can be used with the amount of liquid production to determine the liquid production history during the drill stem test. With the production of liquid well fluids known for a given interval of time during the test, it can be determined whether the liquid production alone was sufficient to produce the surface pressure measurements recorded during that interval. If the liquid production alone cannot account for the surface pressure changes, a multi-phase pressure-volume-temperature relationship can be used to approximate the incremental gas fluid production that would account for the surface pressure change. A fairly accurate (but non-real time) production history can be obtained in this manner for the further determination of reservoir properties.

Thus, conventional drill stem tests, whether open flow or closed chamber, suffer from various errors and uncertainties inherent in measuring and recording dynamic pressure during the flow periods and shut-in periods, and from multi-phase well fluids which hamper the real time determination of well fluid production.

The present invention is directed to an improved method of determining formation interval parameters during a drill stem test by utilizing an acoustic sounding device to accurately determine liquid well fluid level. Accordingly, the present invention provides a new method for more accurately determining the volume of liquid recovery during drill stem testing.

SUMMARY OF THE INVENTION

In one aspect of the present invention, a method is provided for determining the volume of well fluid produced during a drill stem test by generating an acoustic signal capable of propagating down a well containing drill stem test tubing, measuring the travel time of an acoustic signal reflected from an identifiable reference point in the tubing, measuring the travel time of the acoustic signal reflected from a well fluid level, and then determining the volume of well fluid produced based on the travel times of the reflected acoustic signals. The acoustic signal travel times are determined by monitoring the well with an automated, digital well sounder and the acoustic signal is generated by releasing compressed gas into the drill stem test tubing.

In another embodiment of the present invention, the production rate of a subterranean formation during a closed chamber drill stem test is determined by generating an acoustic signal which is communicated down a well, measuring the travel time of an acoustic signal reflected from an identifiable reference point in the well, opening a tester valve to commence a flow period of well fluids into a closed chamber, measuring pressure and temperature inside the drill stem test tubing during the flow period, measuring a travel time for an acoustic signal reflected from a fluid level in the closed chamber during the flow period, determining the well fluid production properties during the flow period based upon the travel times of the reflected acoustic signals. The acoustic signal travel times are measured by an automated, digital well sounder. The acoustic signal is generated by releasing compressed gas into the drill stem test tubing.

In a still further embodiment of the present invention, the volume of well fluid produced during a drill stem test is determined by generating an acoustic signal capable of propagating down a well containing drill stem test tubing, measuring a travel time of an acoustic signal reflected from an identifiable reference point in the drill stem test tubing, measuring a travel time of an acoustic signal reflected from a liquid level in the drill stem test tubing during a flow interval, determining a volume of liquid produced during the flow interval based on the travel time of the reflected acoustic signal, and, determining the total amount of well fluid produced during the flow interval based on the of volume of liquid produced and the surface pressure measurements during the flow period. The acoustic signal is generated by releasing compressed gas into the drill stem test tubing. The total amount of well fluid produced is determined by a computer.

DETAILED DESCRIPTION OF A PREFERRED EMBODIMENT

Figure 1:
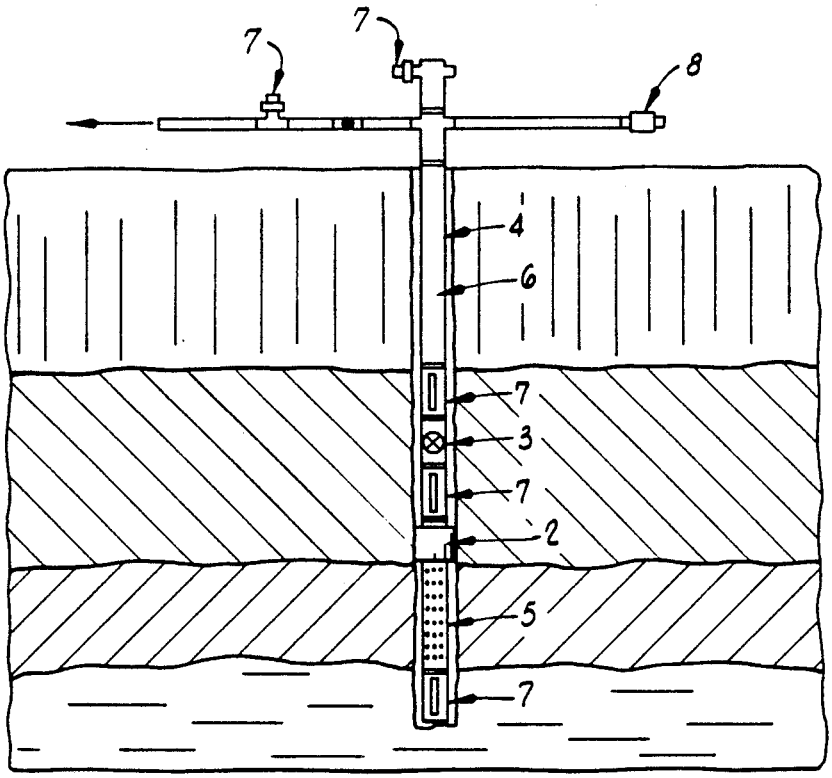
FIG. 1 shows a closed-chamber drill stem test utilizing an acoustic sounding device.

FIG. 1 illustrates a typical setup for a closed-chamber drill stem test in an open hole. The formation interval 1 to be tested is isolated from the rest of the wellbore formation by a packer 2. Above the packer is a tester valve 3 which is closed at the beginning of the test and is opened for a period of time known as the flow period. Well fluids enter the drill pipe string 4 through the flush joint anchor 5. The well fluid begins to fill the drill pipe chamber 6. Prior to and during the flow period, a transducer 7 monitors and records properties of the well. Such transducers monitor and record, for example, pressure, surface pressure, temperature, rate of change of pressure, and rate of change of surface pressure. In addition to the transducer 7, an acoustic sounding device 8 is employed consisting of at least an acoustic signal receiver and preferably an acoustic signal generator/receiver. The acoustic sounding device is capable of receiving or transducing any acoustic signal reflected by wellbore components such as the drill pipe or well fluid.

Prior to beginning a flow period, the well fluids will typically have risen to just below the tester valve 3. The acoustic well sounder 8 is used to determine the travel time of an acoustic signal from the acoustic signal generator 8 to an identifiable reference point. The reference point can be the tester valve 3 itself, a change in diameter of the drill pipe or any other known point that will reflect all or part of the acoustic signal back to the receiver 8.

During a flow period, as the well fluid level rises into the chamber 6, the acoustic sounding device is used to determine travel times for the acoustic wave as it is reflected by the well fluid. Decreasing travel times for the reflected acoustic signal indicate increasing well fluid levels. Because it is known that the acoustic signal travels at a known rate, i.e., the speed of sound, in a given environment, changes in the travel time of the reflected signal from one fluid level to the next can be converted into fluid level heights. Fluid level height can be converted into fluid volume change based on the pipe dimensions within the closed-chamber. Typically, several measurements are made with the acoustic sounding device during the flow period. The interval between each measurement is known as the flow interval. If only one acoustic sounding measurement is made, the flow interval is equal to the flow period.

A suitably programmed computer or data acquisition device 13 can be used to acquire the data generated (e.g., surface pressure, acoustic signal travel time) to calculate the volume of liquid well fluid produced during a specified time interval (e.g., a flow interval) during the test. This liquid well fluid production can immediately be compared with the change in surface pressure over that time interval and a determination made as to the component part of gaseous well fluid produced during that interval, if any. Thus, a real time, or at least quasi-real time, determination of the amount and characteristics of multi-phase well fluid produced during a specified time interval during an ongoing closed chamber drill stem test can be made. Although the description of the present invention utilizes the closed chamber drill stem test, those skilled in the art will recognize its applicability to open flow drill stem testing as well.

The acoustic sounding device 8 may be any number of devices for generating and transducing an acoustic signal or other pressure wave of sufficient energy to be reflected by wellbore components such as collars, tester valves, changes in drill pipe or tubing geometry and the well fluid/wellbore gas interface. Typical acoustic signal generators include the pulsed release of compressed gases such as Nitrogen or the firing of ballistic shells (e.g., shotgun shells). The acoustic signal can be introduced directly into the tubing. If the acoustic signal is introduced into the annulus region, there should be no drilling mud or other fluid that would prevent the acoustic signal from reaching the well fluid interface or prevent the reflected signal from reaching the acoustic sounding device 8.

In a preferred embodiment, the acoustic sounding device 8 consists of the Diagnostics Services Inc., St★r Sounder, an automated digital well sounding device. The St★r Sounder is disclosed and claimed in U.S. Pat. No. 4,853,901 and is incorporated by reference as if fully set forth herein. In a preferred embodiment, generation of the acoustic signal is accomplished by the release of compressed Nitrogen into the tubing region.

Figure 2:
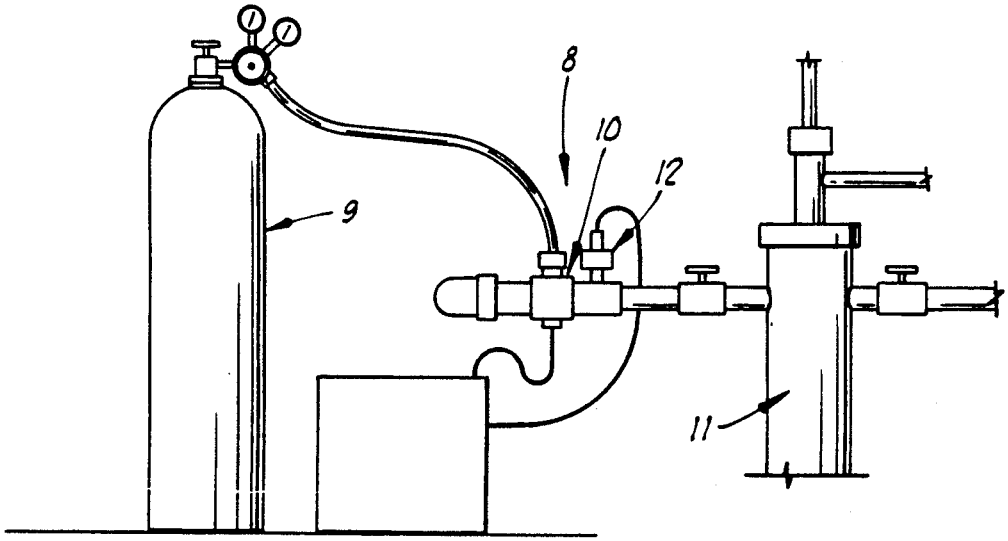
FIG. 2 shows an acoustic sounding device utilizing a compressed gas acoustic signal generator.

Referring now to FIG. 2, the acoustic signal is generated by releasing compressed nitrogen 9 through a gun valve 10 into a flo-tee 11 or other structure capable of communicating the acoustic signal into the tubing. An acoustic transducer 12, typically of the piezoelectric crystal type, is positioned adjacent the gun valve 10 and transduces the acoustic signal generated by the shot of Nitrogen into the tubing as well as any reflected acoustic signals.

Numerous modifications and variations of the present invention are possible in light of the above disclosure. It is therefore understood that within the scope of the appended claims, the invention may be practiced otherwise than as specifically described herein:

What is claimed is:

1. A method for determining a rate of production of well fluid produced during a closed chamber drill stem test of a subterranean formation comprising the steps of:

(1) generating an acoustic signal capable of propagating down a well containing a drill stem test tubing;

(2) measuring a travel time of an acoustic signal reflected from an identifiable reference point in the drill stem test tubing;

(3) flowing the subterranean formation a predetermined length of time;

(4) measuring a travel time of an acoustic signal reflected from a liquid level in the drill stem test tubing during the flow interval;

(5) shutting in the flow of the subterranean formation;

(6) determining a volume of liquid produced during the flow interval based on the travel time of the reflected acoustic signal;

(7) determining a total amount of well fluid produced during the flow interval based on the volume of fluid produced and the surface pressure measurements during the flow period; and (8) determining the rate of production from the subterranean formation during the flow period.

2. The method of claim 1 wherein the acoustic signal is generated by releasing compressed gas into the drill stem test tubing.

3. The method of claim 1 wherein the total amount of well fluid produced is determined by a computer.

4. A method for determining production properties of a subterranean formation intersected by a wellbore, said wellbore containing a workstring having a surface valve and a downhole tester valve, the surface valve having an open and close position and the downhole tester valve having an open and close position, the method comprising the steps of:

(1) closing the surface valve;

(2) generating an acoustic signal;

(3) communicating the acoustic signal down the workstring;

(4) measuring a travel time of an acoustic signal reflected from an identifiable reference point in the workstring;

(5) opening the downhole tester valve so that the subterranean formation flows a well fluid into the workstring for a predetermined amount of time;

(6) measuring pressure and temperature as a function of time during the flow period;

(7) closing the downhole tester valve after a predetermined amount of time;

(8) measuring a travel time for an acoustic signal reflected from a fluid level in the closed chamber during a flow interval;

(9) determining a rate of production from the well fluid production during the flow interval based upon the travel times of the reflected acoustic signals.

(10) calculating the production properties of the subterranean formation based on the rate of production.

5. The method of claim 4, further comprising the steps of:

(11) repeating the steps 2–10 of claim 11 until the workstring is filled with the well fluid from the subterranean formation.

6. The method of claim 5 wherein the acoustic signal travel time is determined by monitoring the well with an automated, digital well sounder.

7. The method of claim 6 wherein the acoustic signal is generated by releasing compressed gas into the workstring.

* * * * *